United States Patent [19]

Krueger

[11] 3,980,926

[45] Sept. 14, 1976

[54] SPIRAL SCAN DISPLAY APPARATUS WITH TRANSIENT SUPPRESSION MEANS

[75] Inventor: Thomas Allen Krueger, Los Angeles, Calif.

[73] Assignee: Honeywell Inc., Minneapolis, Minn.

[22] Filed: Jan. 30, 1974

[21] Appl. No.: 437,794

[52] U.S. Cl. ..... 315/378; 315/384; 340/324 A

[51] Int. Cl.[2] ..... H01J 29/78

[58] Field of Search ..... 315/380, 381, 378, 384, 315/385, 30; 340/324 A; 343/5 PC

[56] References Cited

UNITED STATES PATENTS

| | | | |
|---|---|---|---|
| 2,180,153 | 11/1939 | Kuehni | 315/381 |
| 2,222,943 | 11/1940 | George | 315/381 |
| 2,421,312 | 5/1947 | Bobb | 315/378 |
| 2,426,208 | 8/1947 | Hardy | 315/378 |
| 2,520,141 | 8/1950 | Hardy | 315/378 X |
| 2,768,323 | 10/1956 | Schonover | 315/380 |
| 3,431,459 | 3/1969 | Freeborn | 315/378 |
| 3,579,234 | 5/1971 | Tsumura et al. | 343/5 |
| 3,684,915 | 8/1972 | Gangawere | 315/378 |
| 3,757,040 | 9/1973 | Bennett et al. | 178/6.8 |
| 3,772,457 | 11/1973 | Macovski | 178/6.8 |
| 3,833,934 | 9/1974 | Roark | 343/5 PC |

*Primary Examiner*—Maynard R. Wilbur
*Assistant Examiner*—T. M. Blum

[57] ABSTRACT

High speed, spiral scan display apparatus capable of producing distortion free visual presentations from stored video data, and a method for preventing occurrence of visible distortion caused by switching transients in such apparatus. The visual presentations are generated by display writing means which traces a circular path on a display area. The radius of the circular path is periodically incremented to provide for scanning the entire display area. Visible distortion resulting from rapidly changing the path radius is prevented by blanking the display writing means for an interval of time immediately following each radius change. Data storage requirements are minimized by ordering and retrieving video data so that only data sequentially needed during unblanked intervals is supplied to the display writing means.

9 Claims, 5 Drawing Figures

PRIOR ART
| MEMORY | |
|---|---|
| RING 1 | POINT 1 |
| RING 1 | POINT 2 |
| ⋮ | |
| RING 1 | POINT N |
| RING 2 | POINT 1 |
| ⋮ | |
| RING 2 | POINT N |
| ⋮ | |
| RING M | POINT 1 |
| ⋮ | |
| RING M | POINT N |
FIG. 2a
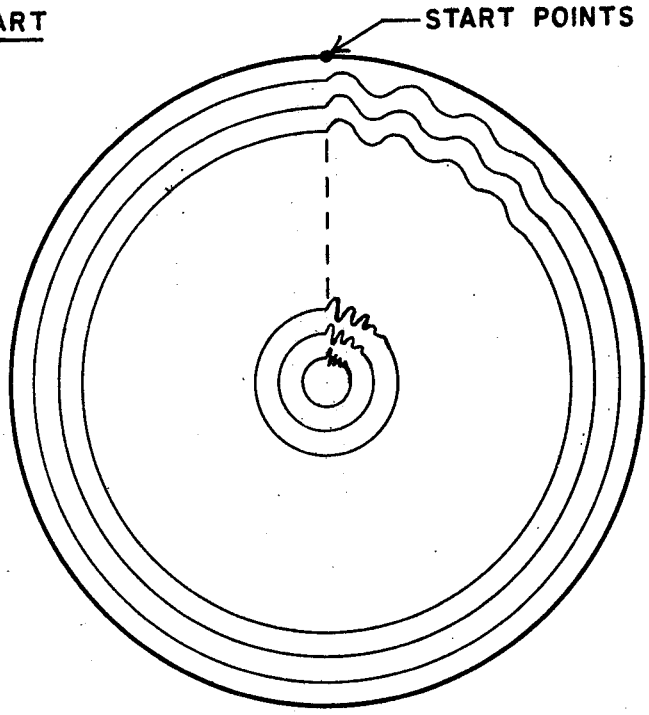
FIG. 2b
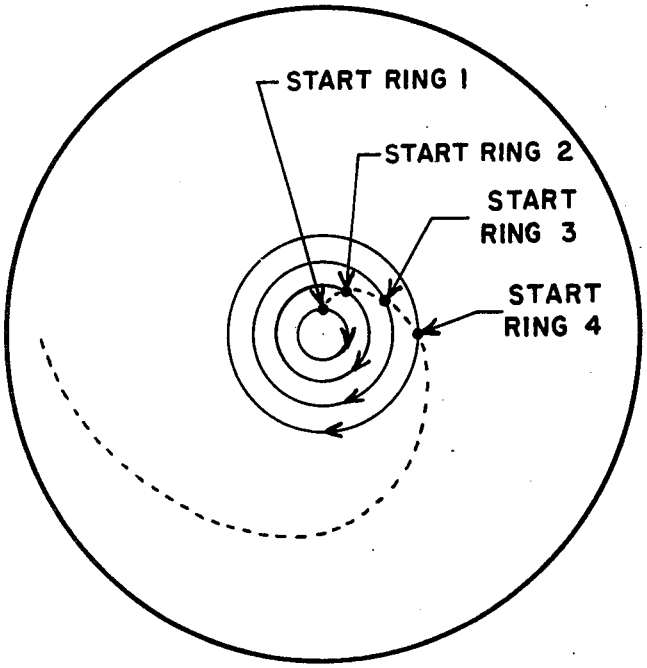
FIG. 3

SPIRAL SCAN DISPLAY APPARATUS WITH TRANSIENT SUPPRESSION MEANS

The invention herein described was made in the course of or under a contract, or subcontract thereunder, with the Department of the Navy.

BACKGROUND OF THE INVENTION

The invention pertains generally to improved systems for generating displays from stored video data, and more particularly to spiral scan display apparatus capable of high speed generation of distortion free visual presentations.

It has become common practice to produce visual presentations on a display device in accordance with information in digital form supplied by a computer or other source of digital signals. Various techniques for converting the digital data to a visual form are known. The techniques are implemented in common display apparatus by spiral scan as well as raster scan methods. One common type of display apparatus employs a cathode ray tube as the display device. Several known techniques are used in connection with cathode ray tube display apparatus for obtaining display presentations of sufficient persistence to permit visual observation. One such technique is to utilize long persistence phosphors in the cathode ray tube so that the presentation remains visible for an interval of time after scanning by the electron beam. This technique is not suitable for displays which must be updated at very frequent intervals or for displays in which significant information is contained in the relative brightness levels of points on the display area.

A second technique involves continually refreshing the visual presentation by repeatedly displaying the video data in such rapid succession that a constant visual appearance is provided. This technique permits very frequent updating of the presentation, and also permits information to be conveyed in the form of brightness levels and variations on the display area.

In order to produce a satisfactory display by the latter technique, the entire display area must be scanned at very frequent intervals. In general, careful synchronization of the video input data with position of the electron beam (or other display writing means) is required. As a practical matter, such synchronization involves critical timing relationships and predictable positioning of the electron beam. Problems in implementing these criteria are compounded as the updating speed and display content and accuracy requirements are increased.

In a digitally driven display of the spiral scan type, the display writing means (electron beam in a cathode ray tube) is deflected around a circular path whose radius is periodically incremented so as to scan a display area. One of the problems encountered in achieving very high speed operation in display apparatus of this type is that switching transients are caused as the beam path radius is incremented. The radius of the beam path must be switched very rapidly in order to meet the time requirements for completing a scan of the display area. It has been found that switching of the beam path radius is frequently followed by an interval of transient oscillation of beam position about its intended path. This is reflected on the generated display as an area of distortion.

The applicant's invention is a method and apparatus for overcoming this problem by suppressing any visual presentation during intervals when undesired transients exist. The applicant has discovered that this may be accomplished primarily through a unique reordering of the stored video data in conjunction with minor changes and additions to existing display apparatus.

SUMMARY OF THE INVENTION

The applicant's invention comprises a method and means for preventing undesired transient excursions of the display writing means in spiral scan display apparatus from distorting the visual presentation. The invention involves suppressing generation of any visual presentation by the display writing means for an interval of time immediately following each change in radius of the circular path traced thereby, and organizing the video data so that only data to be sequentially displayed is supplied to the display writing means, and then only during intervals in which generation of a visual presentation is permitted. The display apparatus may comprise a cathode ray tube and means for deflecting the electron beam therein around a circular path whose radius is periodically incremented. The electron beam is blanked through a predetermined angle after each change in path radius. Data means for sequentially supplying video data signals may comprise memory means for storing video data in the order corresponding to points on the display area successively crossed by the unblanked beam. Memory access means is provided for supplying video data to the electron beam in the stored order and at a uniform rate except immediately following each path radius change when a delay equal to the blanked interval is provided.

BRIEF DESCRIPTION OF THE DRAWINGS

FIGS. 2*a* and 2*b* respectively illustrate prior art organization of stored video data and visible distortion on prior art spiral scan display apparatus permitted by such organization and associated display apparatus;

FIG. 3 illustrates the display area in apparatus according to the applicant's invention, and identifies the relative locations of starting points for generation of a visual presentation along the circular path followed by the display writing means as the path radius is incremented.

DESCRIPTION OF THE PREFERRED EMBODIMENT

Figure 1:
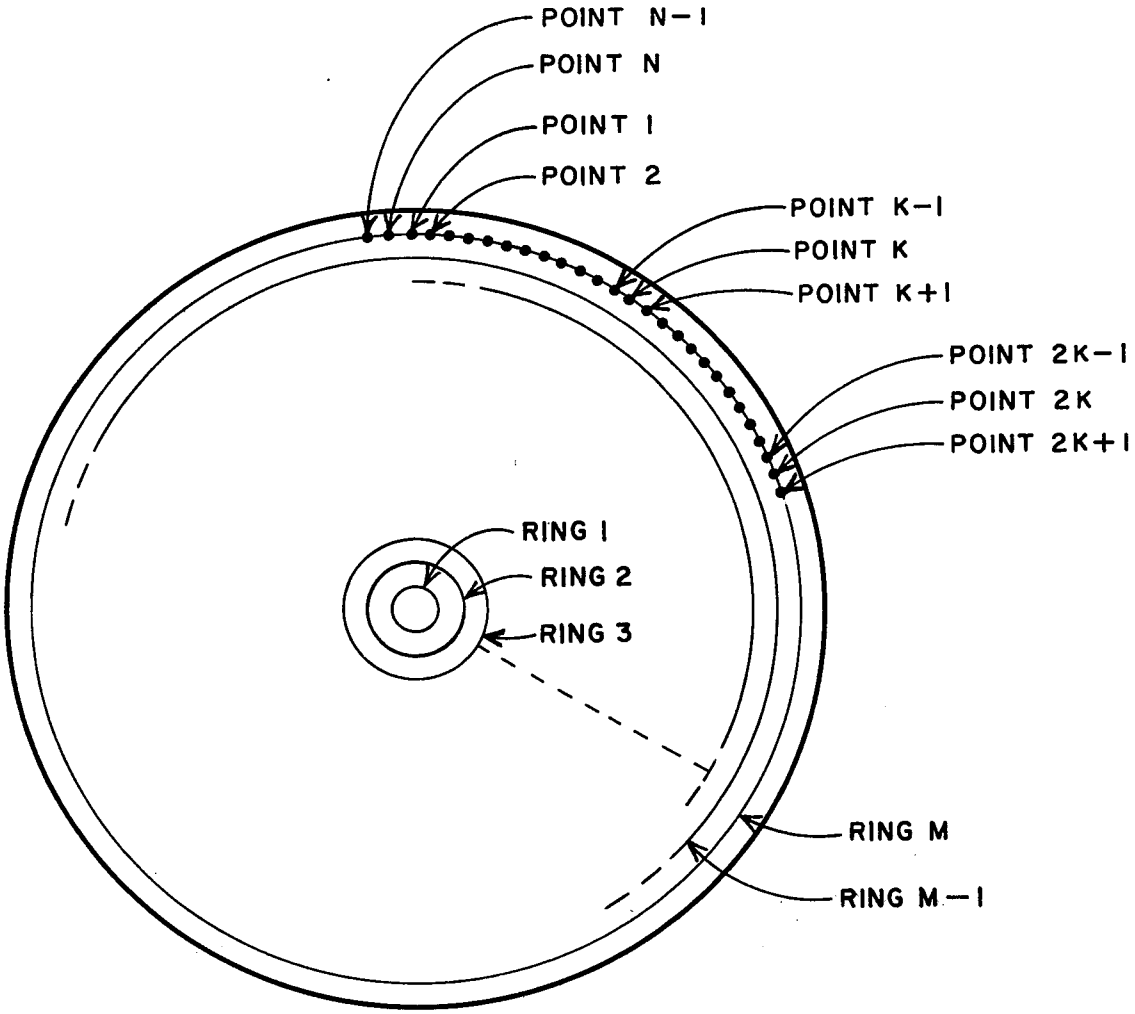
FIG. 1 represents a display area on a spiral scan display device and identifies locations thereon to which reference will be made in describing the applicant's invention.

FIG. 1 represents a display area, as for example, the face of a cathode ray tube, on which a display is to be generated by display writing means tracing a generally spiral path. The display writing means may comprise the writing element in any of a variety of display devices. However, for convenience in the following description it will be referred to as an electron beam in a cathode ray tube. More accurately stated, the path traced by the electron beam (writing means) lies along a plurality of concentric circles. The radius of the beam path is periodically incremented so that the entire display area is periodically scanned.

The points at which discrete visual presentations appear lie at the intersections of the concentric circles and radial lines. The path traced by the electron beam and the points at which discrete visual presentations appear are located on rings identified in FIG. 1 as ring 1 through ring M. Locations identified by the same point numeral or letter on the several rings lie along a radial line on the display area. For example, point 1 on rings 1 through M lie along a radial line at the 12 o'clock position. The total number of such points on the display area is the product of the number of rings and the number of points on each ring, or a total of MN points.

For purposes of the following discussion, it will be assumed that the electron beam traces a path starting at ring 1, point 1, and moves in a clockwise direction. After completely tracing ring 1, the beam is switched to ring 2 and a complete circle at that radius is traced. This sequence is followed until a circular path at the radius of ring M is traced, whereupon the beam returns to ring 1, point 1 to again begin scanning the display area. It is pointed out that the particular path described is for illustrative purposes only. The beam could equally as well begin scanning the display area from any point on ring M or any ring between ring 1 and ring M, and proceed to scan the display area along a path of either increasing or decreasing radius.

Stored video data for generating visual presentations at the identified points on the display area are retrieved from storage and supplied to the electron beam in synchronism with the beam position so as to produce a commplete display. Typical prior art organization of stored video data is illustrated in FIG. 2*a*. Assuming that the path traced by the electron beam starts at ring 1, point 1 and is incremented to the next larger ring after each complete revolution, the video data is sequentially stored in order of ring 1, point 1 through ring M, point N, and is retrieved in that order for display generation.

As indicated in FIG. 2*b*, such data organization typically requires that the starting points for the beam along each successively larger ring lie along a single radial line. Also illustrated in FIG. 2*b* are transient oscillations in the path traced by the beam immediately following each change in path radius. Such oscillations result from the operation of circuitry for switching the beam path between adjacent rings sufficiently rapidly to achieve the overall operational speed required from the display apparatus. The oscillations result in an area of visible distortion on the display. Such distortion is unacceptable in high performance display apparatus.

The previously discussed problems are avoided in the applicant's invention by implementing the display so that the electron beam is blanked or prevented from producing a visual presentation during the interval time in which oscillations occur. Thereafter the beam is unblanked and sequentially supplied with video data for at least a complete beam revolution. This method is illustrated in FIG. 3 where the points at which visual presentations are commenced on successively larger rings are shown skewed about the center of the display from the 12 o'clock position. More specifically, the point at which visual presentation is commenced on ring 1 is shown at the 12 o'clock position. The beam then completes a circular path at the radius of ring 1 while generating a visual presentation in accordance with stored video data. After presentation of video data at the radius of ring 1 is completed, the beam is switched to ring 2. Simultaneously therewith the beam is blanked and remains blanked for an interval of time sufficient to permit oscillations in the beam path to settle out. No video data is supplied to the beam during the blanked interval. Following the blanked interval, the beam is supplied with video data corresponding to the beam position on ring 2. The beam continues to receive sequential video data until a complete circle of data at the radius of ring 2 is presented. The beam is then blanked and switched to ring 3. This process is continued until the beam has scanned the entire display area, at which time the beam returns to ring 1 and commences to refresh the display. As a result of this process, no visual presentation is permitted during the intervals in which the beam is oscillating about its proper path. In addition, video data for every point on the display area is presented by retracing the blanked portion of the path at the end of each beam revolution. Thus, a complete display free of visual distortion is provided.

Figure 4:
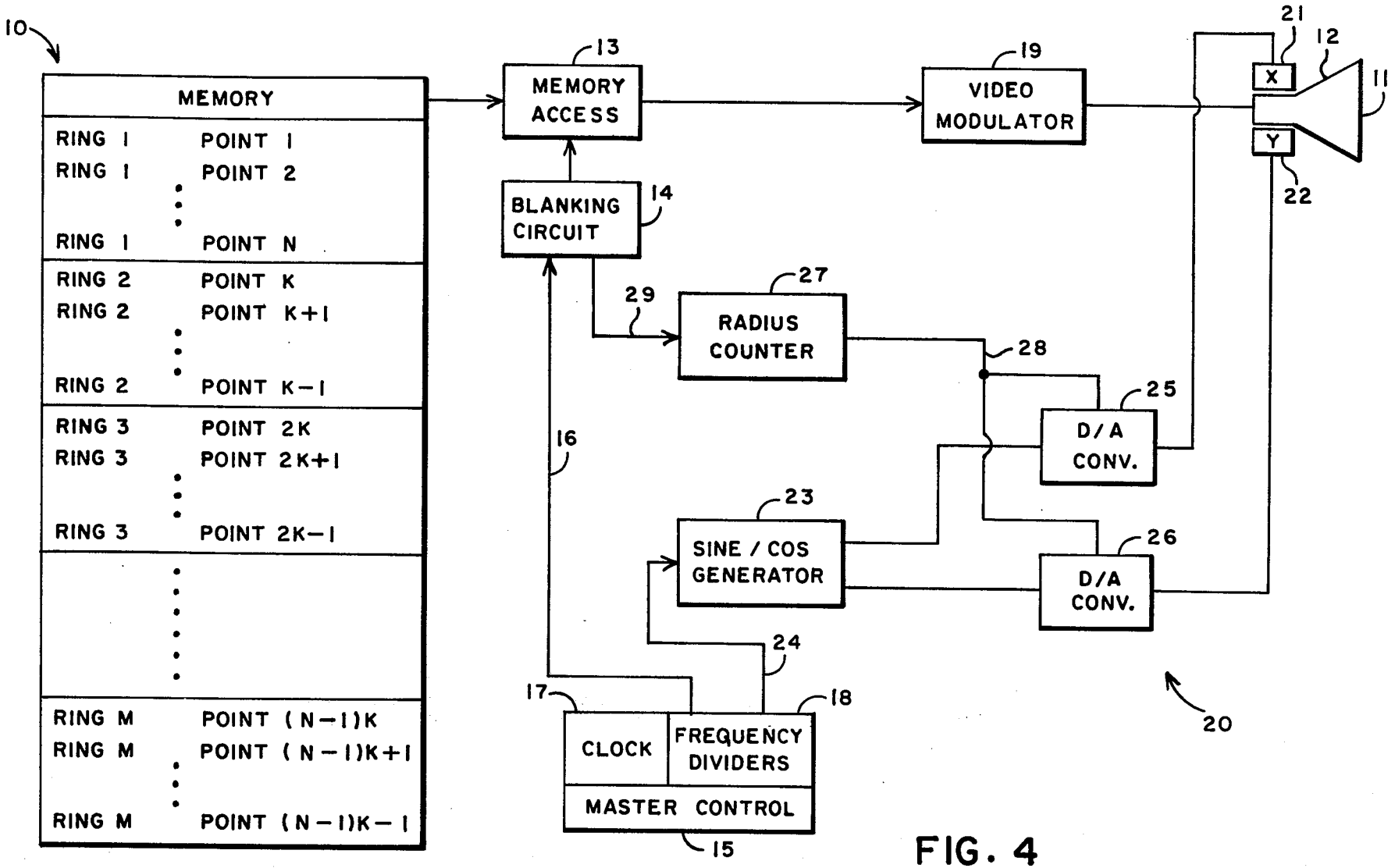
FIG. 4 shows the applicant's unique organization for stored video data and a functional block diagram of spiral scan display apparatus for utilizing data so organized to generate a distortion free display.

The applicant has discovered that such a display can be generated with uncomplicated apparatus primarily by reorganizing the video data in a unique order. FIG. 4 illustrates apparatus and video data organization in accordance with the applicant's invention for achieving a complete, high speed, distortion free display. Reference numeral 10 generally identifies data storage or memory means containing video data for generating a display on a display area 11 which, as illustrated, is the face of a cathode ray tube 12. Memory 10 may comprise any digital data storage means having fast access time. A large variety of such memories are commercially available.

As illustrated in FIG. 4, memory 10 includes a number of memory locations, each identified by a unique combination of ring and point designators which correspond to discrete points on display area 11. Reference may be made to FIG. 1, which utilizes the same designators, for identification of locations on the display area. Video data for the points on the display area are placed in the appropriate memory locations by conventional techniques, and may be updated with any required frequency.

Data are retrieved from memory by conventional memory access means 13 which, in accordance with the data organization illustrated for memory 10, sequentially addresses the memory locations in the order listed from top to bottom. For purposes of the following discussion, memory 10 and memory access 13 are collectively referred to as data means. As indicated in the listing, M rings are contemplated, each comprising N points. In accordance with the discussion of FIG. 3, a blanking interval corresponding to the time required for the beam to pass K points is provided. One practical embodiment of the applicant's invention employed 512 rings, each including 720 points. A blanking interval covering 40 points was provided.

Memory access 13 is controlled by a blanking circuit 14 which receives timing signals from a master control 15 on a conductor 16. Master control 15 is shown as comprising a digital clock 17 and frequency dividers 18. The clock frequency must be high enough to provide a clock pulse for each data point to be retrieved. A square wave clock signal having a repetition rate equal to the desired retrieval rate is provided on conductor 16. Blanking circuit 14 may comprise a counter and logic as necessary to alternately supply N clock pulses to memory access 13 and then withhold K clock pulses. Memory access 13 retrieves digital data from one memory location for each clock pulse received. Succeeding clock pulses result in retrieval of digital data from successive memory locations.

Digital data retrieved by memory access 13 is supplied to a video modulator 19 which supplies video modulation signals to the electron beam in cathode ray tube 12. The electron beam is deflected around a circular path whose radius is periodically incremented by deflection circuitry generally identified by reference numeral 20. Deflection circuitry 20 is synchronized with operation of the data means so that video data being supplied to the electron beam corresponds with the beam position.

The electron beam is caused to trace a circular path by application of sine and cosine signals to *x* and *y* deflection plates 21 and 22 associated with cathode ray tube 12 in accordance with well known techniques. The sine and cosine signals are generated by a sine/cosine generator 23. Sine/cosine generator 23 is capable of generating high purity sinusoidal signals in synchronism with a digital clock input signal. Such a generator is described in greater detail in a copending patent application of John C. Freeborn entitled "Stable Amplitude Sine Wave Generator" filed on the same day as this application and assigned to the same assignee. Sine/cosine generator 23 receives a square wave signal from frequency divider 18 through a conductor 24. The period of the square wave on conductor 24 is N times the period of the square wave on conductor 16, and thus corresponds to the time required to retrieve video data from N locations. Each complete square wave supplied to sine/cosine generator 23 results in generation of one cycle of sinusoidal signal. Thus, video data are retrieved from storage at a rate corresponding to the rate at which the beam crosses points on each ring in the display area.

The sine and cosine signals generated by generator 23 are supplied to multiplying D/A converters 25 and 26 which are respectively connected to deflection plates 23 and 24. D/A converters 25 and 26 serve to increment the magnitudes of the sine and cosine signals supplied thereto in accordance with a voltage supplied by radius counter 27 on conductor 28. A D/A converter of a type suitable for use at 25 and 26 is disclosed in greater detail in a copending patent application of John C. Freeborn entitled "D to A Converter With Transient Free, High Speed Switching Circuitry" filed on the same data as this application and assigned to the same assignee.

As previously indicated, blanking circuit 14 counts clock pulses supplied thereto on conductor 16 and alternately transmits N pulses and withholds K pulses from memory access 13. After each K + N pulse count blank-circuit 13 provides a pulse on a conductor 29 which is connected to a radius counter 27. Radius counter 27 responds to each pulse on conductor 29 by incrementing the voltage on conductor 28 by an amount sufficient to change the path radius of the electron beam to an adjacent ring. After M pulses have been counted, the output of radius counter 28 is reset to its original voltage and the cycle is repeated.

Assuming locations on display area 11 as defined in FIG. 1 and video data retrieved in the order listed in memory 10, and further assuming initial positioning of the electron beam at ring 1, point 1 operation of the apparatus illustrated in FIG. 4 is as follows. Clock pulses at the data retrieval rate are supplied to memory access means 13 through blanking circuit 14. The first of these clock pulses coincides with the beginning of a square wave signal supplied to sine/cosine generator 23. Concurrently, radius counter 27 supplies a voltage to D/A converters 25 and 26 corresponding to an electron beam path having the radius of ring 1. Each clock pulse results in retrieval of video data for a successive point on ring 1. Simultaneously, the beam is positioned at the corresponding point on display area 11. After N clock pulses have passed to memory access 13, blanking circuit 14 terminates transmission of clock pulses for an interval of time equal to K clock pulses. Simultaneously with termination of transmission of clock pulses to memory access 13, radius counter 27 increases its output voltage by one increment. Also simultaneously, sine/cosine generator initiates generation of a new cycle of sinusoidal signal. After the interval equal to K clock pulses, blanking circuit 14 again transfers clock pulses to memory access 13 which begins retrieving video data for ring 2. As indicated, the first video data retrieved for ring 2 corresponds to point K. Sine/cosine generator 24 has, however, continued to operate during the K clock pulse blanking interval. Thus, the electron beam is positioned at point K on ring 2 corresponding to the video data supplied to the electron beam at that time. The process is continued with the radius of the electron beam being periodically incremented and supplied with corresponding video data until the entire display area has been scanned. The process is periodically repeated to refresh the display. Visible distortion is prevented by eliminating any visual presentation for an interval time immediately following each change in radius of the beam path. A complete display is insured by providing that the beam makes a complete revolution in an unblanked condition at each ring. Data storage capacity requirements and access circuitry complexity are minimized by storing and retrieving only sequential data corresponding to successive points crossed by the beam in an unblanked condition.

The applicant's unique method and a specific embodiment of apparatus for producing a high speed spiral scan display are described and shown for illustrative purposes. However, other embodiments which do not depart from the applicant's contemplation and teaching will be apparent to those skilled in the art. A variety of means for generating concentric circles, other sequences for the stored video data, a number of types of memory and display devices, and other lengths of blanked intervals between successive data retrieval periods can be readily incorporated into apparatus and methods in accordance with the applicant's invention. The applicant does not intend to be limited to coverage of the disclosed embodiment, but only by the terms of the appended claims.

What is claimed is:

1. In display apparatus wherein display writing means traces a circular path whose radius is periodically changed so as to scan a display area, and wherein the display writing means responds to stored video data signals to produce a visual presentation on the display area, the improvement which comprises:

blanking means for alternately blanking the display writing means for an interval of time immediately following each change in radius of the circular path, and then unblanking the display writing means for at least a complete revolution;

deflection means for changing the radius of the circular path traced by the display writing means only at the beginning of the intervals during which the display writing means is blanked; and data means for sequentially supplying video data signals to the display writing means only during unblanked intervals and in synchronism with movement of the display writing means.

2. The display apparatus of claim 1 wherein said data means comprises memory means for storing video data, and memory access means for retrieving the video data in the required order only during unblanked intervals of the display writing means.

3. The display apparatus of claim 2 wherein said memory access means addresses locations in said memory means in a predetermined sequence, and wherein successively required video data signals are stored in successively addressed memory locations.

4. The display apparatus of claim 3 wherein:

the display area is on the face of a cathode ray tube;

the display writing means comprises an electron beam in the cathode ray tube;

the electron beam is blanked through a predetermined angle after each complete unblanked revolution; and video data are retrieved from said memory means at a uniform rate except at the end of each complete unblanked revolution when a retrieval delay equal to the blanked interval is provided.

5. A method for preventing display distortion resulting from switching transients in display apparatus of the type wherein video data for a visual presentation are retrieved from storage and supplied to display writing means which traces a circular path whose radius is periodically changed so as to scan a display area, comprising the steps of:

blanking the display writing means during an interval immediately following each change in radius of the circular path;

unblanking the display writing means for at least a complete revolution following each interval during which the display writing means is blanked;

changing the radius of the circular path traced by the display writing means only at the beginning of the intervals during which the display writing means is blanked; and supplying to the display writing means only video data corresponding to points on the display area sequentially crossed by the display writing means during unblanked intervals.

6. The method of claim 5 wherein the step of supplying video data comprises the further steps of:

storing video data for a visual presentation in successively addressed memory locations in the order required by the unblanked display writing means; and retrieving the video data from successively addressed memory locations at a uniform rate except immediately following each change in radius of the circular path when a retrieval delay equal to the blanked interval is provided.

7. Spiral scan display apparatus for generating a visual presentation from stored video data comprising:

a display device including a display area and display writing means which can be positioned at any point on the display area by appropriate deflection signals, the display writing means being responsive to video data signals to produce a visual presentation;

deflection means for supplying deflection signals which cause the display writing means to trace a circular path;

radius control means for changing the radius of the circular path at intervals which exceed by at least a blanking interval the time required for a complete revolution of the display writing means, whereby the display writing means scans the entire display area;

blanking means for alternately preventing the display writing means from generating a visual presentation during the blanking interval immediately following each change in radius of the circular path, and then permitting generation of a visual presentation for at least a complete revolution of the display writing means;

memory means including a plurality of memory locations for storing video data;

data retrieval means for retrieving video data from said memory means in the order required by the display writing means, the retrieved data being only data sequentially required during unblanked intervals; and means for supplying video data signals indicative of the retrieved data to the display writing means.

8. The spiral scan display apparatus of claim 7 wherein:

said data retrieval means successively addresses the plurality of memory locations in a predetermined order for retrieving video data therefrom; and video data are stored in successively addressed memory locations in the order required by the display writing means.

9. The spiral scan display apparatus of claim 8 wherein:

said display device is a cathode ray tube and the display writing means is an electron beam in the cathode ray tube; and video data are retrieved from said memory means at a uniform rate except immediately following each change in radius of the circular path when a retrieval delay equal to the blanking interval is provided.

* * * * *